United States Patent [19]

Bezstarosti et al.

[11] 4,120,326

[45] Oct. 17, 1978

[54] SHED FORMING DEVICE FOR LOOMS

[75] Inventors: Ladislav Bezstarosti; Josef Lzicar; Jiri Lanta, all of Usti nad Orlici; Vladimir Kriz, Brno, all of Czechoslovakia

[73] Assignee: Vyzkumny ustav bavlnarsky, Usti nad Orlici, Czechoslovakia

[21] Appl. No.: 726,491

[22] Filed: Sep. 27, 1976

[30] Foreign Application Priority Data

Oct. 3, 1975 [CS] Czechoslovakia ..... 6699-75

[51] Int. Cl.[2] ..... D03C 13/00; D03C 9/06; D03D 47/26

[52] U.S. Cl. ..... 139/55.1; 139/92; 139/436

[58] Field of Search ..... 139/55–58, 139/79–82, 91.92, 436, 55.1, 455, 456; 403/104, 106, 109, 329, 361, 377

[56] References Cited

U.S. PATENT DOCUMENTS

| | | | |
|---|---|---|---|
| 889,971 | 6/1908 | Salisbury | 139/436 X |
| 2,693,368 | 11/1954 | Petron | 403/104 X |
| 3,258,035 | 6/1966 | Pend | 139/436 |
| 3,263,705 | 8/1966 | Rossmann | 139/436 |
| 3,603,351 | 9/1971 | Piazzolla | 139/79 |
| 3,831,638 | 8/1974 | Selivanov et al. | 139/55 R |
| 3,857,417 | 12/1974 | Selivanov et al. | 139/436 |
| 3,888,284 | 6/1975 | Tiernan et al. | 139/82 |

FOREIGN PATENT DOCUMENTS

| | | | |
|---|---|---|---|
| 875,327 | 4/1953 | Fed. Rep. of Germany | 139/91 |
| 900,664 | 10/1944 | France | 403/329 |
| 1,374,485 | 11/1974 | United Kingdom | 139/92 |
| 317,853 | 2/1972 | U.S.S.R. | 403/104 |

*Primary Examiner*—James Kee Chi

[57] ABSTRACT

An improved shed forming device having two-part heald holders the parts of which are secured together by a quickly detachable connecting means. The means connecting the two portions of the holder is made as a locking means in which the extremity of one portion of the holder is inserted or telescoped into the other portion and is held in the inserted position by a selectively releasable pawl. With the heald holders of the invention, warp threads may be drawn into the healds, when changing the weaving design or the number of healds in the individual holders, outside and away from the loom; thus reducing the idle time of the loom to a minimum. With the locking means there is preferably provided means for unlocking the pawl and for shifting the two portions of the holder relative to each other.

The device of the invention may incorporate a cursor running or guide means extending across the loom, the cursor selectively locking the two portions of successive holders together or unlocking them from each other.

14 Claims, 20 Drawing Figures

SHED FORMING DEVICE FOR LOOMS

The present invention relates to a shed forming device in weaving looms, comprising heald holders and a mechanism for controlling the strokes thereof. The device is particularly suitable for travelling-wave shedding looms in which warp threads form shed waves travelling one after the other across the weaving loom while weft inserters are advanced in the zones of maximum amplitude of said waves.

As known, in travelling-wave shedding looms, the individual healds or heald sections are secured in the upper portion of their holders while the lower portions of the holders are connected to a stroke controlling mechanism. Well-known heald holders are usually each formed as an integral element. However, a shed forming device is also known which comprises separate upper and lower holder parts which partially overlap each other and which are fixedly attached to each other by screws.

Sometimes during the exchange of warp beams the warp threads of the fresh beam cannot be pieced up to the respective threads of the woven-off beam. This occurs, for instance, when changing the weaving design, or the number of healds in the individual sections. The drawing-in of the warp threads has to be carried out, even in such cases, in situ in the loom, an operation which is very time-consuming and therefore disadvantageous.

The need to proceed in this way is caused by the fact that the parts of the well-known heald holders, including the aforementioned screwed together two-part holders, cannot be easily disconnected from each other.

It is an object of the present invention to enable the warp threads to be drawn into the healds, when changing the weaving design or the number of healds in the individual holders, outside and away from the loom, and thus to reduce the idle time of the loom as much as possible.

The present invention eliminates the drawbacks of the prior art as hereinabove referred to. Among the objects of the invention is the provision of an improved shed forming device comprising two-part heald holders wherein the connection of the two portions of the holder is effected as a lock in which the extremity of one portion of the holder is inserted or telescoped into the other portion and is held in the inserted position by a pawl. When necessary, such an arrangement permits the upper portion of the holder together with the healds to be quickly and easily separated from the lower portion thereof by unlocking the pawl and by withdrawing the extremity of the one portion of the holder out of the other portion.

During the exchange of warp beams, it is necessary only to remove the upper portions of the holders and to replace them by holders with healds into which warp threads have been previously drawn-in outside the loom. The idle time of the loom can thus be reduced to a minimum.

Preferably, the insertable portion of the holders terminates in a core to be inserted into a sleeve provided at the mating extremity of the other portion of the holder, these being supporting means on the core or on the sleeve for engagement with a pawl provided on the core or on the sleeve, the pawl and/or the supporting means therefore being spring-loaded.

With the locking means there is preferably associated disengaging means for unlocking the pawl and for shifting the two portions of the holder relative to each other.

The pawl can be attached to the sleeve by a resilient holder, while a cutout for said holder and a recess are provided in the core, the recess constituting the supporting means for the pawl.

In a first embodiment, the pawl is forced into engagement with the recess by the resilient holder. In this embodiment the disengaging means is formed as a crowbar to be inserted into the spacing between two pins, one of which is provided on the sleeve and the other on the portion of the holder which terminates in the core.

In a second embodiment, the pawl is forced by the resilient holder out of the engagement with the recess, and a slider is arranged in the wall of the sleeve for shifting the pawl into the recess by pushing down the resilient holder. The disengaging means is constituted in this case by a swingable arm for displacing the slider.

The pawl can take the form of a pin protruding from the core, and the supporting means can be formed as a recess in the sleeve, the core being slanted to deflect the sleeve or the core, respectively; the pawl is unlocked by spacing the recess apart from a pin opposite the action of a spring secured in the cutout of the core.

In another preferred embodiment, the pawl is formed as a projection at the edge of the sleeve, such projection being pointed to the interior of the sleeve, and the supporting means is formed as a notch in an arm journalled to swing in the cutout of the core and forced by a spring toward the projection. The arm is provided at its extremity with a protrusion adapted to be pushed down for unlocking the pawl by spacing the notch apart from the projection. The disengaging means shown employed in this embodiment is also capable of assuming the function of a coupling means; it is constituted by a cursor mounted for shifting across the loom and provided with two guiding grooves of which the lower horizontal groove is engageable by a pin protruding from the lower portion of the holder while the upper, partly horizontal, partly slanted groove is engageable by a pin protruding from the upper portion of the holder, an onrun path being provided between the guiding grooves for pushing down the protrusion into the interior of the holder and for thus unlocking the pawl.

In a still further preferred embodiment, the pawl is in the form of a pivot in the sleeve, and the supporting means is in the form of a slot at the extremity of the core, the mouth of said slot being spring-loaded. The disengaging means shown employed in this embodiment, which is capable of also assuming the function of a coupling means is constituted by a cursor mounted for shifting across the loom and provided with two superposed guiding grooves, the lower horizontal groove being engageable by a roll supported upon a pivot protruding from the lower portion of the holder while the upper slanted groove is engageable by a roll supported upon a pivot protruding from the upper portion of the holder.

In order that the present invention may be better understood and carried out into practice some preferred embodiments thereof will hereinafter be described with reference to the accompanying somewhat schematic drawings which, however, are not intended to limit in any way the scope of the invention.

Figures 1, 20:
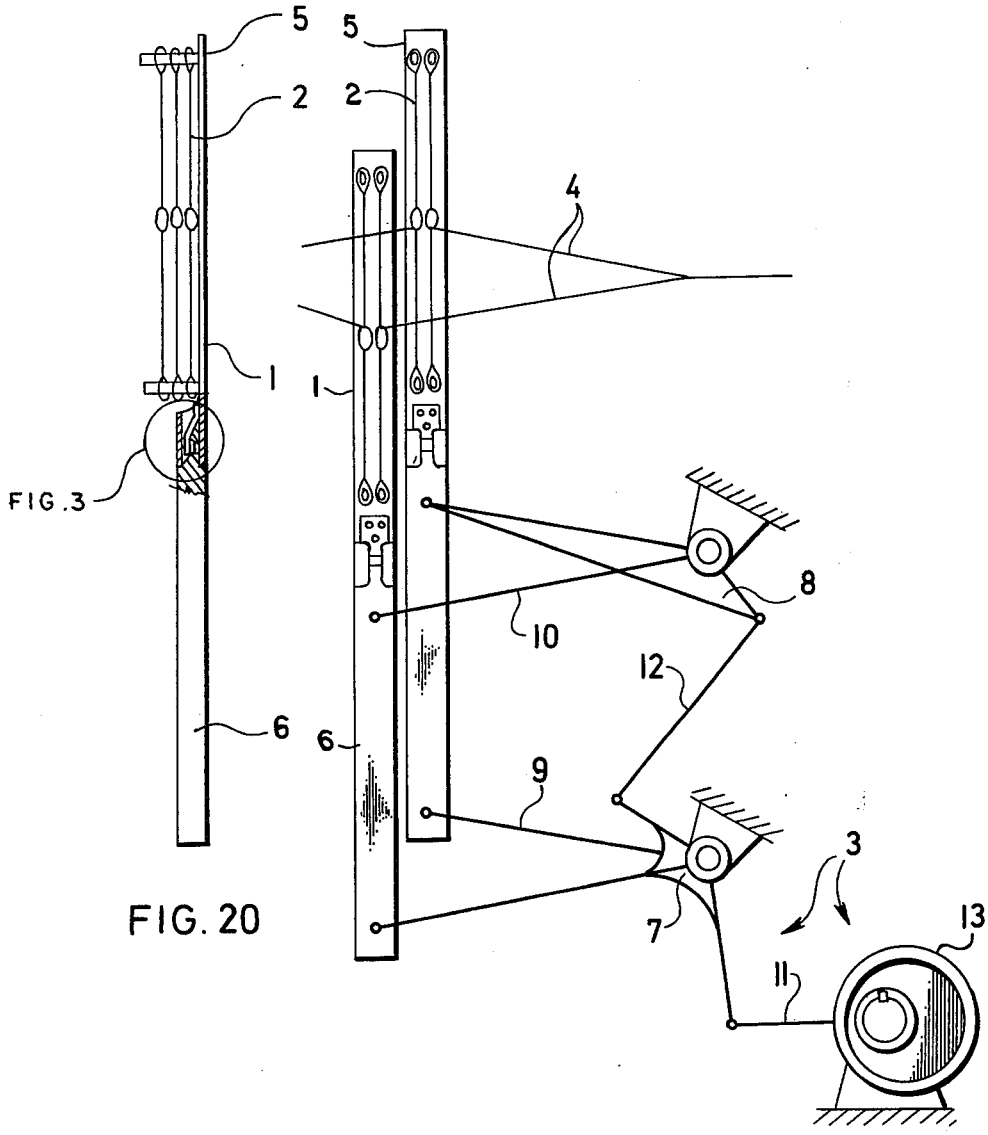
FIG. 1 is a kinematic schematic view of an exemplary embodiment of the device according to the invention.
FIG. 20 is an elevation view of a portion of FIG. 1.

Turning now to FIG. 1, there is there schematically shown a shed forming device comprising holders 1, healds 2 and a mechanism 3 for causing and controlling the stroke thereof. The healds 2 through which warp threads 4 extend, are fixed in upper portions 5 of the holders 1. FIG. 20 includes a circle portion leveled FIG. 3. Lower portions 6 of the holders 1 are driven by the heald stroke controlling mechanism 3; thus they are coupled via a system of levers 7, 8, arms 9, 10 and pull-rods 11, 12 with control cams 13. As is also apparent from FIG. 1, the portions 5 and 6 constitute two separate members which are connected with each other in the loom.

A numer of embodiments of a lock in accordance with the invention for interconnecting these portions of the holders will hereinafter be described.

In the first embodiment, shown in FIGS. 2, 3, 4 and 5, the upper portion 5 of the holder 1 terminates in a sleeve 14 which is telescoped over a core 15 provided at the upper end of the lower portion 6 of the holder 1, the lower end of the sleeve abutting a shoulder 16 on the core. In this relative position, the two portions 5, 6 are locked together by a pawl 17 on the free end of the leaf spring 18 attached to the sleeve 14. A cutout 19 for the spring 18 is provided in the core 15, as well as a recess 20, the latter forming means for supporting the pawl 17. The pawl 17 is thrust into engagement with the recess 20 by spring 18.

To separate the upper portion 5 of the holder 1 from the lower portion 6 thereof, the sleeve 14 is withdrawn from the core 15 upon the unlocking of the pawl 17 and its being slid out of the recess 20.

Figure 3:
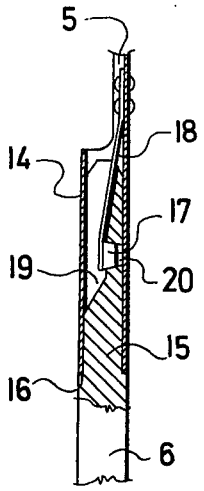
FIG. 3 is a sectional view taken along the line III—III in FIG. 2.
Figure 2:
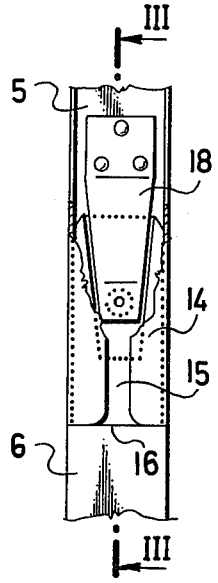
FIG. 2 is a front view, partially in section, of a part of the heald holder in a first exemplary embodiment thereof in the region where the upper and the lower holder portions are connected to each other.
Figure 5:
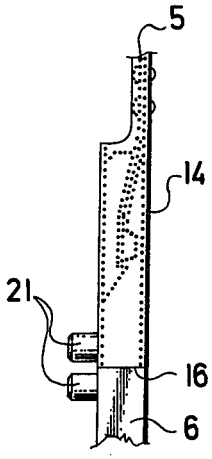
FIG. 5 is a side view of the embodiment shown in FIG. 4.
Figure 4:
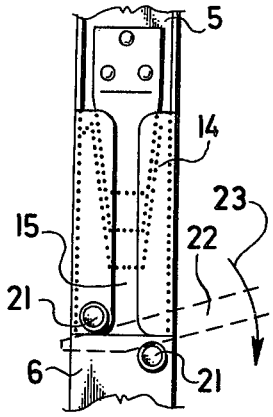
FIG. 4 is a detail view of the holder in the embodiment according to FIG. 2, provided with a holder portion separating means.

The embodiment shown in FIGS. 4 and 5 differs from that shown in FIGS. 2 and 3 in that it comprises a pair of pins 21 of which one is provided on the sleeve 14 and the other on the lower portion 6 below the shoulder 16. Into the spacing between said pins 21 a prybar 22 (FIG. 4) can be inserted. By pushing down said prybar 22 in the direction of arrow 23, the pawl 17 becomes unlocked when it slides out of the recess 20 while the sleeve 14 is simultaneously shifted along the core 15. The sleeve 14 can be withdrawn immediately from the core 15 so that the two portions 5, 6 of the holder 1 become separated from each other.

Figure 7:
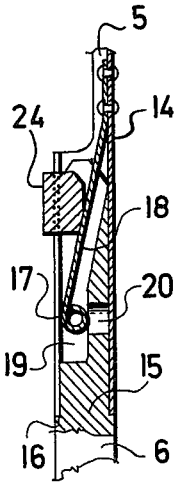
FIG. 7 is a sectional view taken along the line VII — VII in FIG. 6.
Figure 6:
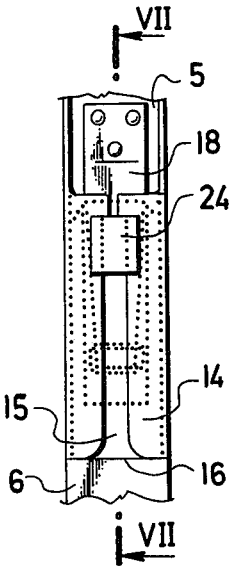
FIG. 6 is a front view of a holder detail in a second exemplary embodiment.
Figure 8:
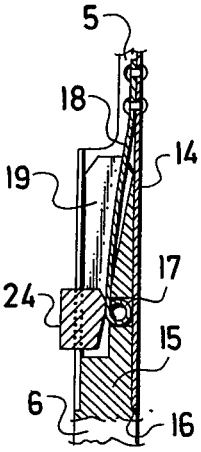
FIG. 8 is a view similar to FIG. 7, but with a cursor in the lower position.

In the embodiment shown in FIGS. 6, 7 and 8 the pawl 17 is constituted by an eyelet provided at the extremity of a spring forming a resilient holder 18 for the pawl 17. The difference from the aforedescribed embodiment consists in that the pawl 17 is forced by said resilient holder 18 from engagement with the recess 20. A slider 24 is provided in the wall of the sleeve 14 for arresting the lock after drawing the sleeve 14 off the core 15. By shifting the slider 24 from its upper positions (FIGS. 6 and 7) into its lower position (FIG. 8) the resilient holder 18 is depressed and the pawl 17 enters the recess 20.

Figure 9:
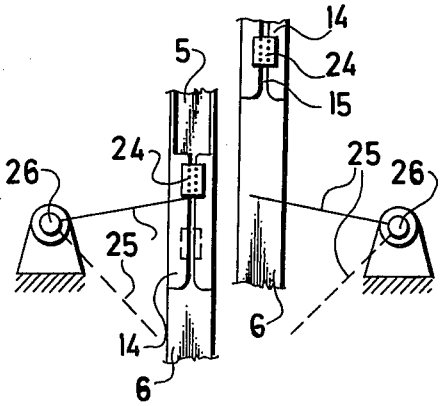
FIG. 9 is a kinematic schematic view of the disengaging means for the second embodiment of the holder as shown in FIGS. 6, 7 and 8.

A disengaging means suitable for use with this embodiment is shown in FIG. 9. It consists of arms 25 affixed to a shaft 26 extending across the loom. In operation, the arms 25 are in their lowermost positions (dash-line) and the sliders 24 are also in their lower positions. To separate the upper portions 5 of the holders 1 from the lower portions 6, the shafts 26 are turned so as to swing the arms 25 upwards into their uppermost (full line) positions. With those holders 1 of healds 2 which are at this instant in their lower positions (see the left-hand side of FIG. 9), the arms 25 displace the sliders 24 into the upper position so that the pawls 17 become unlocked and the upper portions 5 of the holders 1 can then be removed from the lower parts 6. The other holders 1 of healds 2 at this instant are in the upper position (see the right-hand side of FIG. 9); their pawls 17 become unlocked after a corresponding turn of the loom shaft while the aforesaid holders 1 descend to their lower positions.

Figure 10:
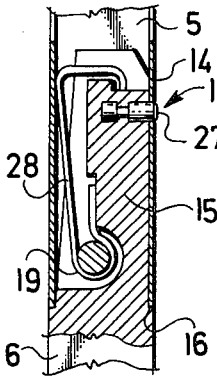
FIG. 10 is a detail sectional view of a third embodiment of the holder.
Figure 11:
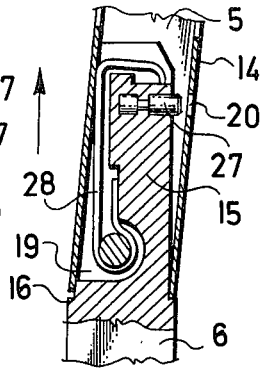
FIG. 11 is a view similar to FIG. 10 but with the upper portion of the holder being deflected.
Figure 16:
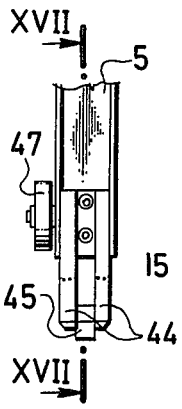
FIG. 16 is a side view of the lower end of the upper portion of the holder shown in FIG. 14.
Figure 17:
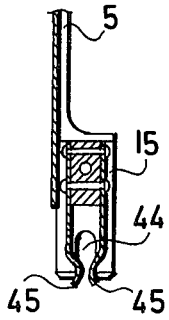
FIG. 17 is a sectional view taken along the line XVII — XVII in FIG. 16.
Figure 18:
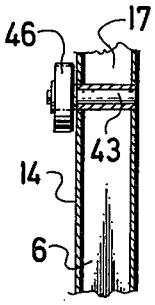
FIG. 18 is a sectional view of the upper end of the lower portion of the holder shown in FIG. 14.
Figure 19:
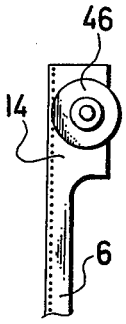
FIG. 19 is a front view of the upper end of the lower portion of the holder shown in FIG. 18.

As shown in FIGS. 10 and 11, the pawl 17 is there embodied as a pin 27 extending from the core 15 in which the lower portion 6 of the holder 1 terminates. The supporting means is constituted by a recess 20 in the sleeve 14 in which the upper portion 5 of the holder 1 terminates. The pawl 17 is forced into engagement with the recess 20 by a spring 28 provided in the cutout 19 of the core 15 and bearing upon the sleeve 14.

One of the walls of the core 15 is slanted so that the sleeve 14 can be tilted, overcoming the action of the spring 28, relative to the core 15 into the position shown in FIG. 11. In this position the pin 27 is unlocked, which means that it is out of the recess 20, so that the upper portion 5 of the holder 1 can be removed from the lower portion 6 thereof.

Figure 12:
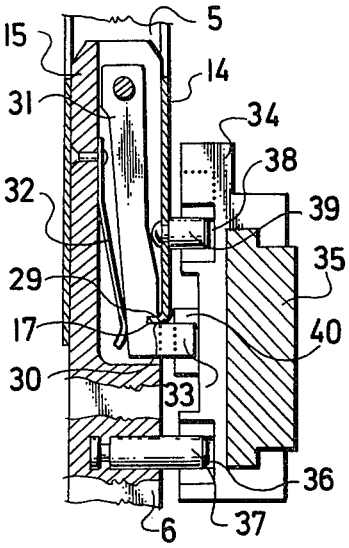
FIG. 12 is a detail sectional view of a fourth embodiment of the holder together with a holder disengaging means.
Figure 13:
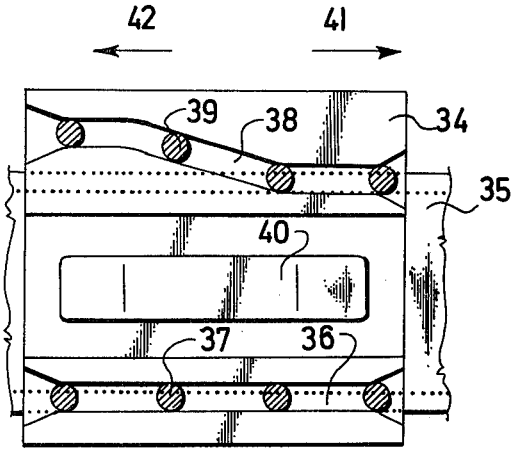
FIG. 13 is a front view of the disengaging means shown in FIG. 12.
Figure 14:
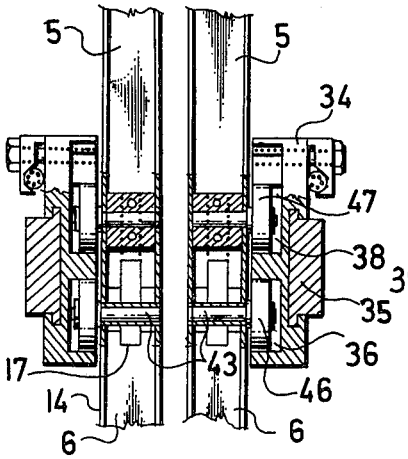
FIG. 14 is a detail sectional view of two holders for two heald frames in a fifth embodiment, together with a disengaging means shown in section.

In the embodiment shown in FIGS. 12 and 13, as in all the aforedescribed embodiments, a sleeve 14 is provided at the extremity of the upper portion 5 of the holder 1 and the core 15 at the extremity of the lower portion 6 thereof. The pawl 17 is made here as a projection 29 on the edge of the sleeve 14, which projection 29 extends into the interior of said sleeve 14. The supporting means is formed as a notch 30 in an arm 31 journalled at its opposite end to swing into the cutout 19 of the core 15, and is forced by a spring 32 into engagement with the projection 29. Below the notch 30, the arm 31 is provided with a protrusion 33 which can be pushed down, overcoming the action of the spring 32, for unlocking the pawl 17 by withdrawing notch 30 from the projection 29.

Associated with this lock is a disengaging means which is common to all the holders 1 of healds 2 of one and the same heald frame. This disengaging means is constituted by a cursor 34 mounted for shifting along a bar 35 extending across the loom. The cursor 34 is provided with two guiding grooves 36 and 38. The lower horizontal guiding groove 36 is engaged by a pin 37 protruding from the lower portion 6 of the holder 1 while the upper, partly horizontal, partly slated guiding groove 38 is engaged by a pin 39 extending from the sleeve 14. Between the grooves 36 and 38 there is provided an onrun path 40 for pushing down the protrusion 33 into the interior of the holder 1.

When the upper portions 5 of the holders 1 with the healds 2 is to be removed from the lower portions 6, the cursor 34 is shifted along the bar 35 across the loom in the direction of arrow 41, that is from the left to the right as shown in FIG. 13. Upon engagement with the onrun path 40 the protrusions 33 are pushed down, whereby the pawls 17 are unlocked, since the notches 30 move out of the engagement with the projections 29. Immediately afterwards, the pins 39 are lifted by the action of the slanted section of the upper guiding groove 38 so that the sleeve 14 will be displaced on the core 15. In this way there is made possible an easy removal of the upper portions 5 of the holders 1 from the lower portions 6 thereof.

After the upper portions 5 of the holders 1 with the healds 2 have been set upon the lower portions 6, the cursor 34 is shifted in the opposite direction (arrow 42), that is, from the right to the left. Owing to the engagement between the pin 39 and the slanted section of the upper guiding groove 38, the upper portion 5 of the holder 1 is at first retracted into its lower position relative to the lower portion 6 whereupon the onrun path 40 releases the protrusion 33 and the spring 32 forces the arm 31 against the sleeve 14, so that the projection 29 moves into engagement with the notch 30.

A smooth continuous engagement and disengagement of the two portions 5 and 5 of the holders 1 with and from each other, respectively, is also provided by the embodiment as shown in FIGS. 14, 15, 16, 17, 18 and 19.

In this embodment, the lower portion 6 of the holder 1 terminates in the sleeve 14 and is provided with the pawl 17 constituted by a pivot 43 secured in the sleeve 14. The upper portion 5 terminates in the core 15 with a slot 44 forming supporting means for the pawl 17. The mouth of the slot 44 is formed with bent springs 45.

The connection between the upper portion 5 of the holder 1 and the lower portion 6 is established by inserting the core 15 into the sleeve 14. Simultaneously, the pivot 43 slides through the spring-loaded mouth into the slot 44, so that engagement between the pawl 17 and the supporting means is established whereby the connection of the two portions 5 and 6 of the holder is ensured.

The disengaging means for this embodiment (FIGS. 14 and 15) is constituted by a cursor 34 mounted on the bar 35 for reciprocation across the loom. The cursor 34 is provided with two superposed guiding grooves 36 and 38. The lower horizontal guiding groove 36 is engaged by a roll 46 supported about a pivot extending from the lower portion 6 of the holder 1. The upper slanted guiding groove 38 is engaged by a roll 47 mounted upon a pivot extending from the upper portion 5 of the holder 1.

Figure 15:
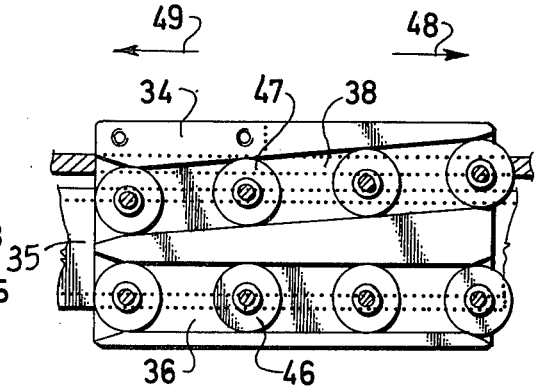
FIG. 15 is a front view of the disengaging means shown in FIG. 14.

The unlocking of the pawls 17 and the disengaging of the two portions 5 and 6 of the holders 1 from each other is effected in this case in a manner similar to that in the preceding embodiment, viz. by shifting the cursor 34 across the loom in the direction of the arrow 48 (FIG. 15). Owing to the engagement with the slanted guide groove 38, the upper portion 5 of the holder 1 is lifted and the slot 44 slides off the pivot 43 whereby the pawl 17 becomes unlocked.

Upon the shifting of the cursor 34 in the opposite direction, in the direction of the arrow 49 (FIG. 15), after the cores 15 of the upper portions 5 of the holders 1 have entered the sleeves 14 of the lower portions 6, the connection of the portions 5, 6 is established by engagement between the slot 44 of the core 15 and pivots 43.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In a travelling-wave shedding loom having a shed forming device comprising heald holders arranged side-by-side in arrays across the warp sheet, and a mechanism for reciprocating and controlling the heald holders, the improvement wherein the upper portion of each holder supports the healds and the lower portion of each holder is drivingly connected with the heald reciprocating mechanism, each said heald holder comprising two separate members which are connected to each other in the loom, a lock for selectively connecting the two members of the holder, said lock comprising one portion of one member of the holder which is formed so that one end thereof may be telescoped into a mating portion of the other member, and a pawl for selectively holding the members in telescoped connected position.

2. Shed forming device as claimed in claim 1, wherein the one portion of said one member of the holder terminates in a core adapted to be inserted into a sleeve provided at the mating portion of the other member of the holder, and comprising supporting means provided on one of the core and a sleeve for engagement with the pawl, the pawl being mounted on the other one of the core and sleeve.

3. Shed forming device as claimed in claim 2, wherein one of the pawls and the supporting means therefor is spring-loaded.

4. Shed forming device as claimed in claim 1, comprising disengaging means for unlocking the pawl and for shifting the two portions of the holder relative to each other.

5. Shed forming device as claimed in claim 3, wherein the pawl is attached by a resilient member to the sleeve, and there are provided a cutout in the core for said holder, and a recess, the latter constituting the supporting means for the pawl.

6. Shed forming device as claimed in claim 5, wherein the pawl is adapted to be forced by the resilient member into engagement with the recess.

7. Shed forming device as claimed in claim 4, comprising two pins, one is provided on the sleeve and the other on that one of the portions of the holder which terminates in the core, the disengaging means being formed as a prybar adapted to be inserted into the spacing between the two pins.

8. Shed forming device as claimed in claim 5, wherein the pawl is adapted to be forced by the resilient holder out of the engagement with the recess and wherein a slider is arranged in the wall of the sleeve for shifting the pawl into the recess by pushing down the resilient holder.

9. Shed forming device as claimed in claim 8, wherein the disengaging means is constituted by a swingable arm for displacing the slider.

10. Shed forming device as claimed in claim 4, wherein the pawl is formed as a pin protruding from the core, and wherein the supporting means is embodied as a recess in the sleeve, the core being slanted to deflect the sleeve relative to the core, and for thus unlocking the pawl by spacing the recess apart from the pin in opposition the action of a spring secured in the cutout of the core.

11. Shed forming device as claimed in claim 4, wherein the pawl is formed as a projection at the edge of the sleeve, said projection being pointed to the interior of the sleeve, and wherein the supporting means is formed as a notch in an arm journalled to swing in the cutout of the core, and forced by a spring toward the projection, the arm being provided at its extremity with a protrusion adopted to be pushed down to unlock the pawl by spacing the notch apart from the projection.

12. Shed forming device as claimed in claim 11, wherein the disengaging means also functions as a coupling means, said disengaging means comprising a cursor mounted for shifting across the loom and provided with two guiding grooves of which the lower groove is horizontal and engageable by a pin protruding from the lower portion of the holder while the upper groove is a partly horizontal and partly slanted groove and is engageable by a pin protruding from the upper portion of the holder, an onrun path being provided between the guiding grooves for pushing the protrusion down into the interior of the holder and for thus unlocking the pawl.

13. Shed forming device as claimed in claim 4, wherein the pawl is in the form of a pivot in the sleeve, and wherein the supporting means is in the form of a slot at the extremity of the core, the mouth of said slot being spring-loaded.

14. Shed forming device as claimed in claim 13, wherein the disengaging means comprises a cursor mounted for shifting across the loom and provided with two superposed guiding grooves, the lower groove being horizontal and engageable by a roll supported about a pivot protruding from the lower portion of the holder, while the upper groove is slanted and engageable by a roll supported about a pivot protruding from the upper portion of the holder.

* * * * *